US009932929B2

(12) United States Patent
Yamashita

(10) Patent No.: US 9,932,929 B2
(45) Date of Patent: Apr. 3, 2018

(54) METHOD FOR MANUFACTURING PISTON FOR DIRECT INJECTION ENGINE

(71) Applicant: TOYOTA JIDOSHA KABUSHIKI KAISHA, Toyota-shi, Aichi-ken (JP)

(72) Inventor: Hideo Yamashita, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/318,006

(22) PCT Filed: Jun. 16, 2015

(86) PCT No.: PCT/JP2015/002998

§ 371 (c)(1),
(2) Date: Dec. 12, 2016

(87) PCT Pub. No.: WO2016/024376

PCT Pub. Date: Feb. 18, 2016

(65) Prior Publication Data

US 2017/0145950 A1 May 25, 2017

(30) Foreign Application Priority Data

Aug. 11, 2014 (JP) ..... 2014-163583

(51) Int. Cl.

| | |
|---|---|
| ***C23C 28/00*** | (2006.01) |
| ***F02F 3/12*** | (2006.01) |
| ***C25D 11/24*** | (2006.01) |
| ***C25D 11/16*** | (2006.01) |
| ***C25D 11/02*** | (2006.01) |
| ***F02B 17/00*** | (2006.01) |

(52) U.S. Cl.
CPC ..... *F02F 3/12* (2013.01); *C25D 11/022* (2013.01); *C25D 11/16* (2013.01); *C25D 11/246* (2013.01); *F02B 17/005* (2013.01); *F02F 2200/00* (2013.01)

(58) Field of Classification Search
CPC ..... C23C 28/00; C23C 28/345
USPC ..... 205/188, 190, 205, 206
See application file for complete search history.

(56) References Cited

U.S. PATENT DOCUMENTS

| | | | | |
|---|---|---|---|---|
| 2004/0257915 | A1* | 12/2004 | Miyama | G04B 37/22 368/280 |
| 2007/0261663 | A1* | 11/2007 | Lineton | B23K 26/34 123/270 |
| 2012/0042859 | A1 | 2/2012 | Sakai | |

FOREIGN PATENT DOCUMENTS

| | | |
|---|---|---|
| JP | 2010-249008 | 11/2010 |
| JP | 2012-72745 | 4/2012 |

OTHER PUBLICATIONS

Prasad et al., "Investigation of Heat Transfer in an Oil Cooled Piston With and Without Ceramic Insulation on Crown Face," Int. J. Mech. Sci. (no month, 1989), vol. 31, No. 10, pp. 765-777. (Year: 1989).*

* cited by examiner

*Primary Examiner* — Edna Wong
(74) *Attorney, Agent, or Firm* — Finnegan, Henderson, Farabow, Garrett & Dunner, LLP

(57) ABSTRACT

A piston for a diesel engine is prepared as a piston for a direct injection engine, a cavity face of the piston is grinded, and a squish face thereof is masked. Next, a high-purity aluminum coating is formed on the cavity face, and the masking of the squish face is removed and the entire area of the piston top face is subjected to an anodizing treatment. Thereafter, the cavity face is masked, and the squish face is subjected to a sealing treatment.

4 Claims, 6 Drawing Sheets

[Fig. 1]
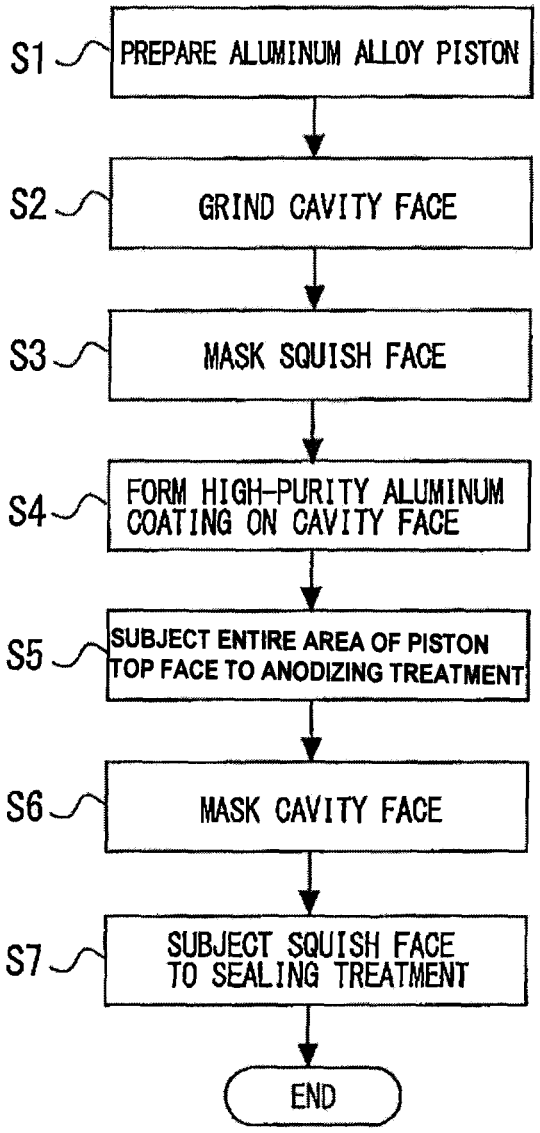

[Fig. 2]
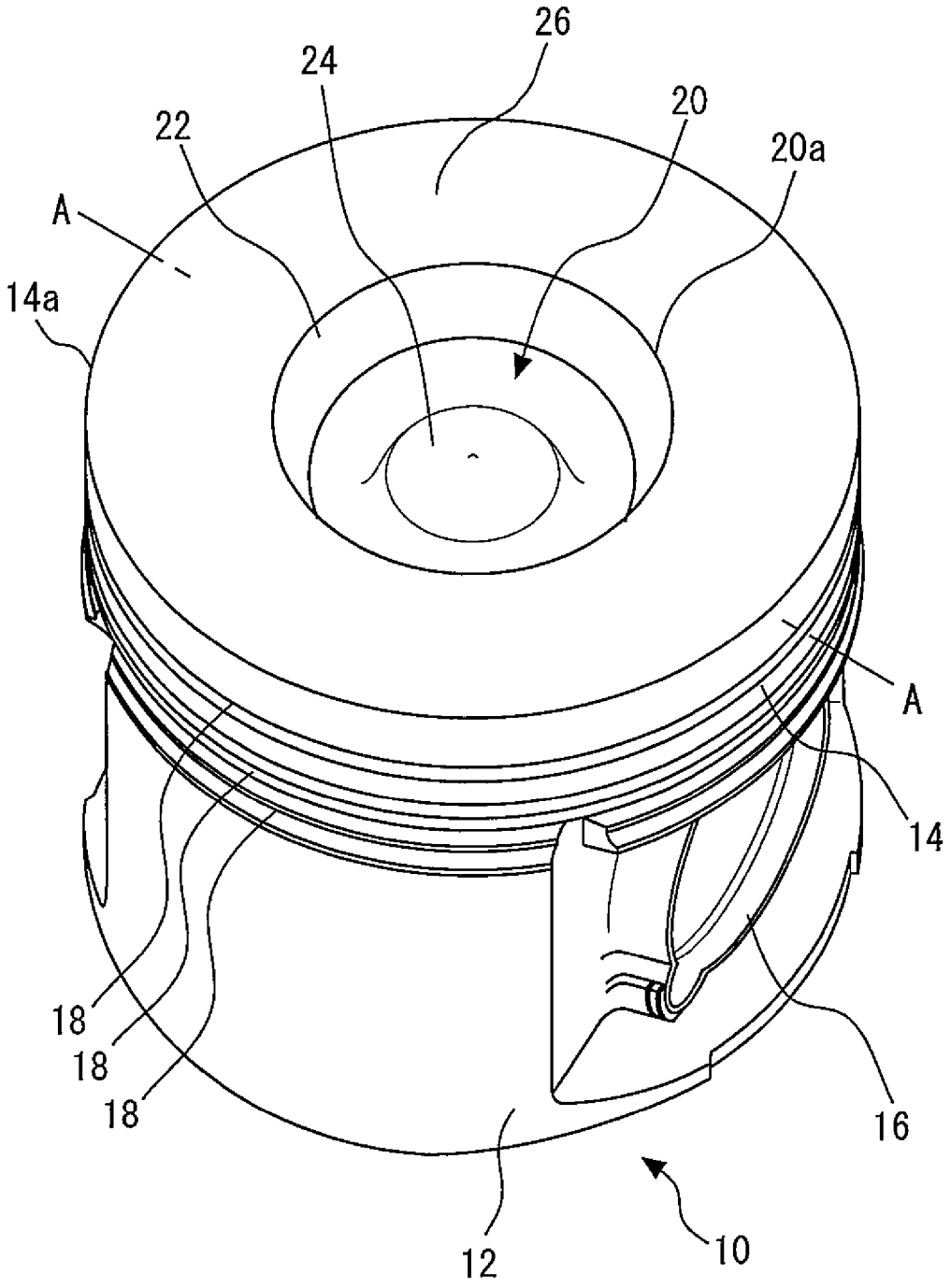

[Fig. 3]
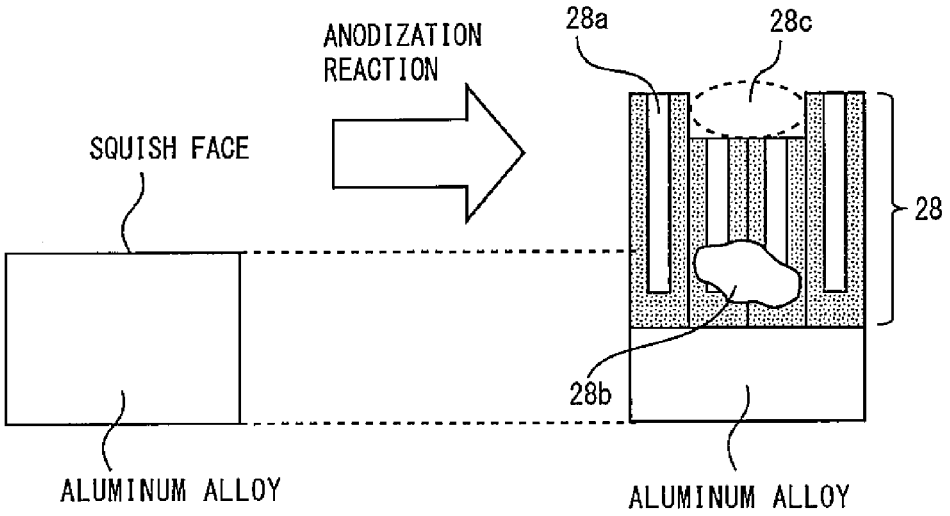
[Fig. 4]
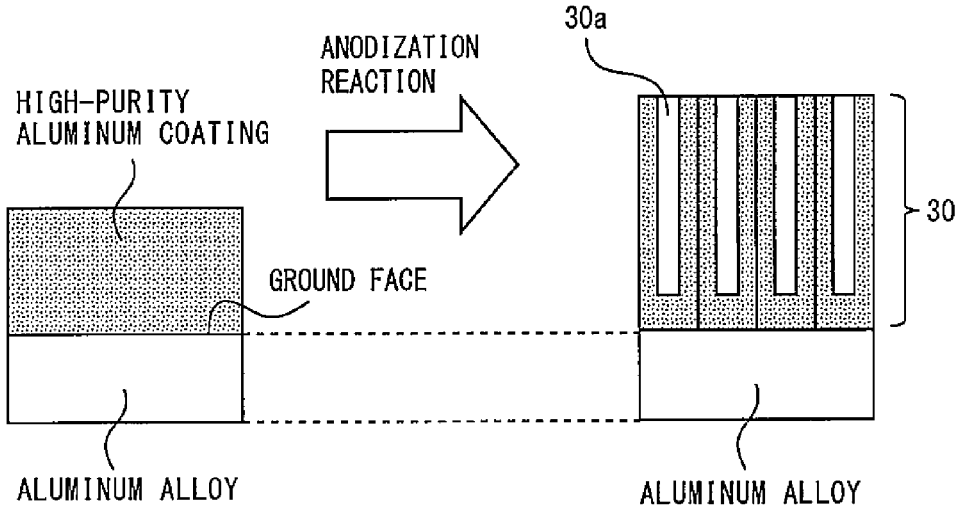
[Fig. 5]
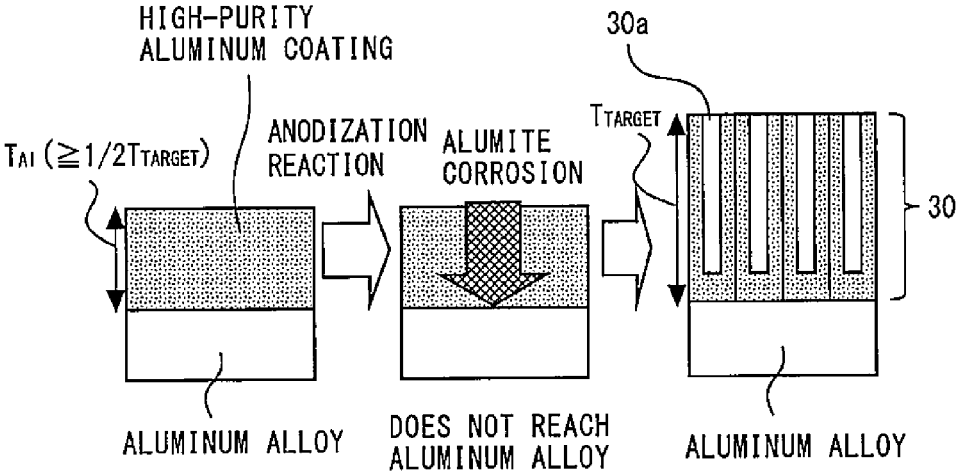

[Fig. 6]
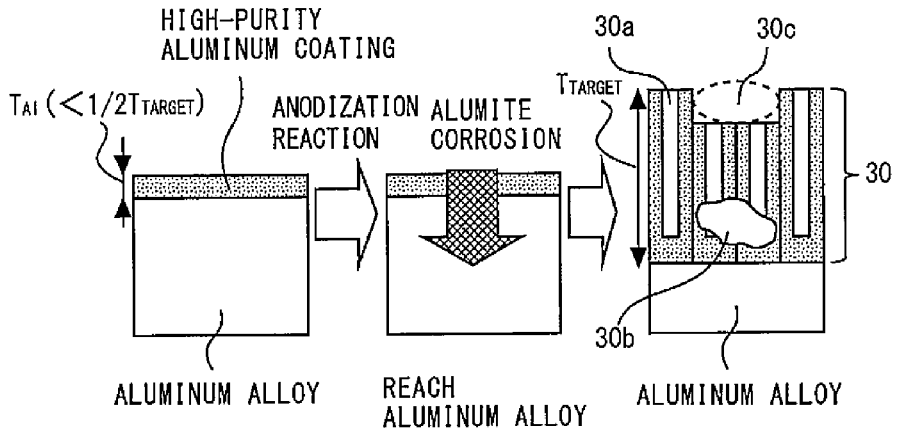
[Fig. 7]
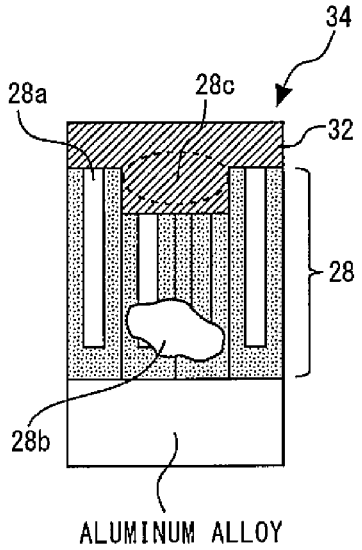
[Fig. 8]
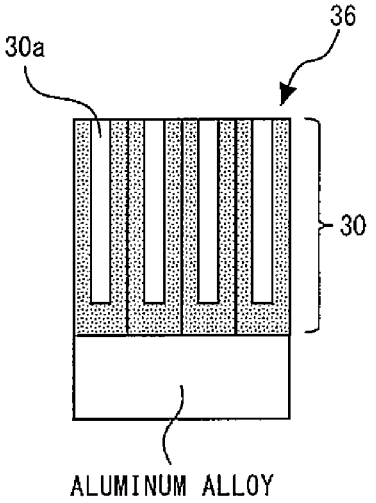

[Fig. 9]
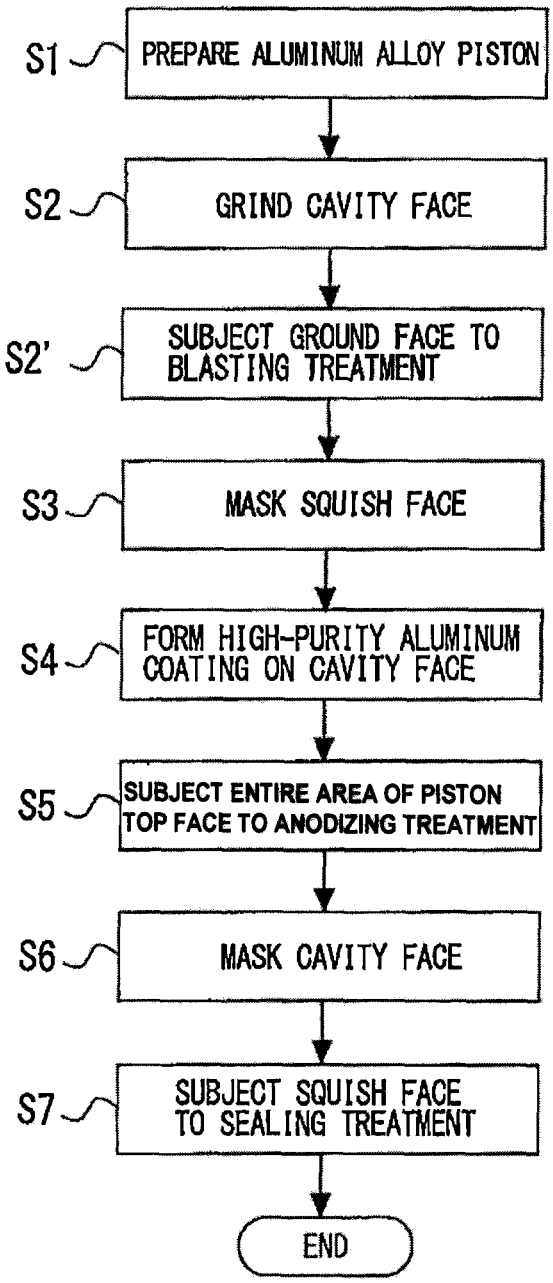

[Fig. 10]
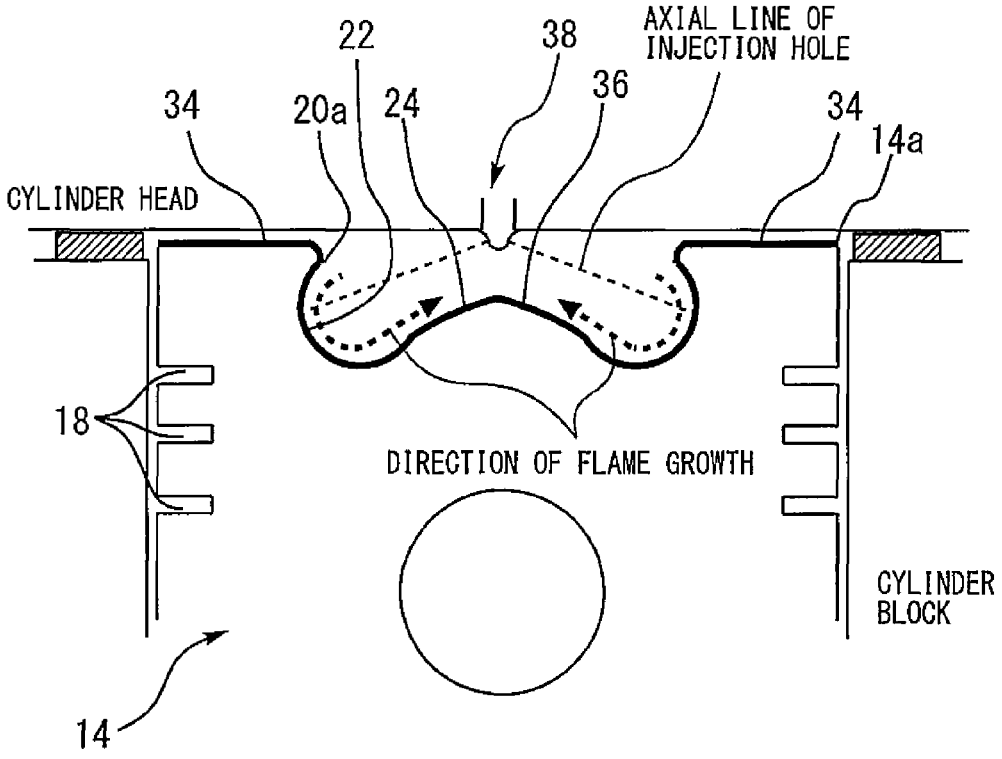

METHOD FOR MANUFACTURING PISTON FOR DIRECT INJECTION ENGINE

CROSS-REFERENCE TO RELATED APPLICATIONS

This application is a national phase application of International Application No. PCT/JP2015/002998, filed Jun. 16, 2015, and claims the priority of Japanese Application No. 2014-163583, filed Aug. 11, 2014, the content of both of which is incorporated herein by reference.

TECHNICAL FIELD

This invention relates to a method for manufacturing a piston for a direct injection engine.

BACKGROUND ART

A method in which the top face of a piston made from an aluminum alloy is subjected to an anodizing treatment to form an anodic oxide coating, and the surface of the anodic oxide coating that is formed as a result is subjected to a sealing treatment is already known. For example, in Japanese Patent Laid-Open No. 2012-72745, a method for manufacturing a piston is disclosed that includes a step of forming a porous layer by subjecting the top face of a piston made of an aluminum alloy to an anodizing treatment, and a step of forming a coating layer that covers the surface of the porous layer by plasma spraying of a $Y_2O_3$-stabilized $ZrO_2$ powder onto the porous layer. Similarly to a common anodic oxide coating, the porous layer has a large number of pores that are formed during the course of the anodizing treatment, and has a lower thermal conductivity and also a lower thermal capacity per unit volume than a conventional ceramic-based heat-shielding coating. Further, the coating layer is formed so as to block the openings of the pores of the porous layers, and the $Y_2O_3$-stabilized $ZrO_2$ has a lower thermal conductivity than the aluminum alloy. Therefore, according to the heat-shielding coating constituted by the coating layer and the porous layer, a low thermal conductivity and a low thermal capacity per unit volume can be realized.

Further, in Japanese Patent Laid-Open No. 2010-249008, a technique is disclosed that forms a silicon oxide coating on the top face of a piston by coating an organic silicon solution onto the outermost surface of an anodic oxide coating formed on the top face of the piston, and performing a heat treatment. Similarly to the above described coating layer, openings of pores in the anodic oxide coating can be blocked by the silicon oxide coating. A low thermal conductivity as well as a low thermal capacity per unit volume can also be realized by this kind of heat-shielding coating constituted by a silicon oxide coating and an anodic oxide coating.

CITATION LIST

Patent Literature

PTL 1: Japanese Patent Laid-Open No. 2012-72745
PTL 2: Japanese Patent Laid-Open No. 2010-249008

SUMMARY OF INVENTION

Technical Problem

An aluminum alloy that is commonly used in a piston includes additives for improving the mechanical properties thereof. However, there is the problem that such additives (mainly silicon) inhibit the formation of an anodic oxide coating, and cause minute irregularities to arise on the surface of the anodic oxide coating that is formed. If irregularities arise on the surface of the anodic oxide coating, the heat transfer area increases and therefore an effect of improving a heat shielding property by means of the anodic oxide coating is lost. Further, if irregularities arise on the surface of the anodic oxide coating, the fluidity of a flame (growth rate of the flame) that is produced by combustion of fuel decreases and the combustion efficiency deteriorates. In this respect, according to the aforementioned sealing coating such as a coating layer or a silicon oxide coating, since the sealing coating can cover irregularities on the surface of the anodic oxide coating and smoothen the surface of the heat-shielding coating, there is the advantage that a decrease in the fluidity of a flame can be suppressed in comparison to a heat-shielding coating constituted by only an anodic oxide coating.

However, the present inventor found that the following problem arises when a piston that has the above described kind of sealing coating formed on the top face thereof is applied to a diesel engine or some types of gasoline engines. That is, in a direct injection engine which injects fuel directly into a cavity portion formed in a concave shape in the top face of a piston, a flame arises as a result of injecting fuel at high pressure into the cavity portion. Consequently, there is the problem that the sealing coating formed in the cavity portion is liable to be locally damaged by the penetrating force of the fuel that is injected at high pressure. If the sealing coating is locally damaged, there is a high possibility that such damage will affect the fluidity of a flame that arises. Furthermore, if the damage progresses and a fragment of the sealing coating detaches from the cavity portion, there is a risk that the cylinder bore will be damaged by the detached fragment or that the detached fragment will bite into a piston ring groove and cause the engine performance to deteriorate.

The present invention has been made in consideration of the above described problem. That is, an object of the present invention is, in a piston having a sealing coating formed on the top face thereof that is used for a direct injection engine, to suppress the occurrence of damage to the sealing coating that is caused by injected fuel.

Solution to Problem

A first invention is a method for manufacturing a piston for a direct injection engine that directly injects fuel into a cavity portion that is formed in a concave shape in a piston top face, comprising:

a piston preparation step of preparing a piston that has the cavity portion and that is made of an aluminum alloy having an aluminum purity of less than 99.0%;

an aluminum coating formation step of forming an aluminum coating having an aluminum purity of 99.0% or more over an entire area of a surface of the cavity portion;

an anodic oxide coating formation step of, after formation of the aluminum coating, forming an anodic oxide coating having pores over an entire area of the piston top face by subjecting the piston top face to an anodizing treatment; and a sealing coating formation step of, after formation of the anodic oxide coating, forming a sealing coating that seals the pores of the anodic oxide coating on an outer side relative to the cavity portion of the piston top face.

A second invention is the method for manufacturing a piston for a direct injection engine according to the first invention, wherein:

the aluminum coating formation step is a step of forming the aluminum coating to a predetermined thickness, and the anodic oxide coating formation step is a step of subjecting the piston top face to an anodizing treatment under conditions such that an aluminum alloy that is on an inner side relative to the aluminum coating that is formed to the predetermined thickness is not anodized.

A third invention is the method for manufacturing a piston for a direct injection engine according to the first or the second invention, wherein:

the aluminum coating formation step is a step of forming the aluminum coating to a predetermined thickness; the method further comprising, between the piston preparation step and the aluminum coating formation step, a grinding step of grinding inwardly a surface of the cavity portion by an amount corresponding to the predetermined thickness.

A fourth invention is the method for manufacturing a piston for a direct injection engine according to any one of the first to the third inventions, wherein the direct injection engine is a diesel engine.

Advantageous Effects of Invention

According to the first invention, after an aluminum coating having an aluminum purity of 99.0% or more is formed over the entire area of the surface of a cavity portion of a piston made of an aluminum alloy having an aluminum purity of less than 99.0%, an anodic oxide coating having pores can be formed over the entire area of the top face of the piston, and thereafter a sealing coating that seals the pores of the anodic oxide coating on the outer side relative to the cavity portion can be formed. Therefore, an anodic oxide coating that is derived from an aluminum coating can be formed on the inner side of the cavity portion, and a heat-shielding coating that is constituted by an anodic oxide coating derived from an aluminum alloy and a sealing coating can be formed on the outer side of the cavity portion. Since the aluminum coating includes almost no additives, the occurrence of minute irregularities on the surface of the anodic oxide coating that is derived from the aluminum coating can be suppressed. Therefore, a decrease in the fluidity of a flame can be suppressed even without forming a sealing coating on the surface of the anodic oxide coating that is derived from the aluminum coating. Further, since a sealing coating need not be formed on the surface of the anodic oxide coating that is derived from the aluminum coating, the problem that a sealing coating formed in the cavity portion is damaged by the penetrating force of injected fuel can be fundamentally solved.

In a case where an aluminum alloy that is on an inner side relative to an aluminum coating is anodized, minute irregularities arise on the surface of an anodic oxide coating derived from the aluminum alloy that is on the inner side, and hence there is the problem that the surface of the anodic oxide coating that is derived from the aluminum alloy becomes rough. In this respect, according to the second invention, the top face of the piston can be subjected to an anodizing treatment under conditions such that an aluminum alloy that is on an inner side relative to an aluminum coating that is formed to a predetermined thickness is not anodized. That is, it is possible to anodize only the aluminum coating, and the surface of the anodic oxide coating that is derived from the aluminum coating can be reliably smoothened.

According to the third invention, the surface of the cavity portion can be ground inwardly by an amount corresponding to a predetermined thickness between a piston preparation step and an aluminum coating formation step. Therefore, the occurrence of a difference in level between the inside and outside of the cavity portion after formation of the aluminum coating can be suppressed.

In general, because the injection pressure of fuel is higher in a diesel engine than in a gasoline engine, a sealing coating formed in a cavity portion in a piston of a diesel engine is liable to be damaged. In this respect, according to the fourth invention, even in the case of applying the invention to a diesel engine, damage of a sealing coating formed in a cavity portion can be suppressed.

BRIEF DESCRIPTION OF DRAWINGS

FIG. 1 is a flowchart for describing the embodiment of the method for manufacturing a piston for a direct injection engine.

FIG. 2 is a perspective view of a piston 10 for a diesel engine.

FIG. 3 is a view for describing the anodizing treatment at the squish portion 26.

FIG. 4 is a view for describing the anodizing treatment at the cavity portion 20.

FIG. 5 is a view for describing the anodizing treatment at the cavity portion 20 in the embodiment.

FIG. 6 is a view for describing the anodizing treatment at the cavity portion 20 in comparison to the anodizing treatment of FIG. 5.

FIG. 7 is a cross-sectional schematic view of the vicinity of the squish portion 26 after the sealing treatment.

FIG. 8 is a cross-sectional schematic view of the vicinity of the cavity portion 20 after the sealing treatment.

FIG. 9 is a view for describing a deformation of the embodiment.

FIG. 10 is a cross-sectional schematic view of a direct injection engine in which a piston manufactured by the flow of operations illustrated in FIG. 1 is mounted.

DESCRIPTION OF EMBODIMENTS

Hereunder, an embodiment of a method for manufacturing a piston for a direct injection engine will be described referring to FIG. 1 to FIG. 10. Note that, in each of the drawings, the same or corresponding portions are denoted by the same reference numerals, and a description of such portions is simplified or omitted.

[Method for Manufacturing Piston]

FIG. 1 is a flowchart for describing the embodiment of the method for manufacturing a piston for a direct injection engine. In the present embodiment, first, a piston for a diesel engine is prepared as a piston for a direct injection engine (step S1). FIG. 2 is a perspective view of a piston 10 for a diesel engine. Similarly to a common engine piston, the piston 10 is formed by casting an aluminum alloy. As shown in FIG. 2, the piston 10 is constituted by a cylindrical skirt portion 12 having a side face that slidingly contacts an inner face of a cylinder block (not shown), a crown portion 14 having a predetermined wall thickness that is formed at an upper end portion of the skirt portion 12, and a pin boss portion 16 that supports a piston pin (not shown).

Three piston ring grooves 18 are formed on the side face of the crown portion 14. A cavity portion 20 is provided in a concave shape in the center of the upper face (hereunder, also referred to as "piston top face") of the crown portion 14.

The cavity portion 20 is constituted by a side wall portion 22 that is formed so as to face the inner part of the crown portion 14 from an opening edge 20*a* of the cavity portion 20, and a truncated cone-shaped ridge portion 24 that is formed to rise upward from a deepest part of the side wall portion 22. A squish portion 26 of the same height as an outer edge 14*a* of the crown portion 14 is formed on the outside of the cavity portion 20. A recess for preventing contact with an intake valve and an exhaust valve is provided as necessary in the surface (hereunder, also referred to as "squish face") of the squish portion 26.

The method for manufacturing the piston will now be described with reference again to FIG. 1. After the piston 10 is prepared in step S1, the entire area of the surface of the cavity portion 20 (hereunder, also referred to as "cavity face") is ground (step S2). Grinding the cavity face in this manner causes the cavity face to recede to the inner side of the piston 10. To suppress the occurrence of a difference in level between the ground face (refers to the cavity face after grinding; the same applies hereunder) and the squish face, grinding of the cavity face is preferably performed only to a degree that grinds an amount of the face that corresponds to a coating thickness $T_{Al}$ (described in detail later in step S4) of a high-purity aluminum coating that is to be formed on the ground face.

After step S2, masking of the squish face is performed (step S3). The masking technique is not particularly limited, and for example a masking tape may be attached to the squish face, or a masking member that is formed to conform to the shape of the piston 10 may be pushed against the squish face.

Following step S3, a high-purity aluminum coating is formed on the cavity face (step S4). The high-purity aluminum coating can be formed by an electroplating method, an evaporation method, a thermal spraying method or a cold spraying method, and forming the high-purity aluminum coating by an electroplating method or an evaporation method in which it is difficult for the intervention of impurities such as aluminum oxide to occur is preferable. The aluminum purity of the high-purity aluminum coating formed by the process in step S4 is 99.0% or more, and preferably is 99.5% or more. Further, it is preferable to make the coating thickness $T_{Al}$ of the high-purity aluminum coating a thickness that is equal to one half or more of a target coating thickness $T_{TARGET}$ of an anodic oxide coating (described in detail later) that is to be formed on the cavity face, and it is more preferable to make the coating thickness $T_{Al}$ a thickness that is equal to one half of the thickness of the target coating thickness $T_{TARGET}$.

After step S4 the entire area of the piston top face is subjected to an anodizing treatment (step S5). More specifically, first, the masking is removed from the squish face and the piston 10 is placed in an electrolyzer. The electrolyzer includes an electrolytic bath containing an electrolyte therein, a cathode and a power source (none of which are shown in the drawings). Next, the cathode and the piston 10 as an anode are placed in the electrolyte, and an anodic oxide coating is formed by passing a current between the two poles.

The details of the anodizing treatment in step S5 will now be described referring to FIG. 3 and FIG. 4. FIG. 3 is a view for describing the anodizing treatment at the squish portion 26, and illustrates a cross-section in the vicinity of the squish portion 26. FIG. 4 is a view for describing the anodizing treatment at the cavity portion 20, and illustrates a cross-section in the vicinity of the cavity portion 20.

As shown in FIG. 3, at the squish portion 26, an aluminum alloy is oxidized from the squish face towards the inner part thereof, and an alumite coating (that is, an anodic oxide coating) 28 grows in a perpendicular direction to the squish face. The alumite coating 28 includes pores (nanopores) 28*a* of several nm to several tens of nm that are formed from the surface thereof towards the inside, and pores (micropores) 28*b* of several tens of mm that are formed inside the alumite coating 28. The micropores 28*b* originate from additives (mainly silicon) in the aluminum alloy that is the base material of the piston (more specifically, an aluminum alloy such as AC8A or AC8B according to JIS H5202 (2010)). The formation of the micropores 28*b* increases the porosity of the alumite coating 28 and can further lower the thermal conductivity and thermal capacity. The porosity (=total volume of nanopores 28*a* and micropores 28*b*' 100/volume of alumite coating 28) of the alumite coating 28 becomes 20% or more as a result of the formation of the nanopores 28*a* and micropores 28*b*. However, concavities 28*c* arise in the surface of the alumite coating 28 when the micropores 28*b* are formed, and a surface roughness Ra (refers to an arithmetic mean roughness in accordance with JIS B601 (2001); the same applies hereunder) of the alumite coating 28 becomes 3 mm or more (average of 4 to 5 mm).

On the other hand, in the cavity portion 20, as shown in FIG. 4, a high-purity aluminum coating is oxidized from the surface towards the inner side thereof. However, the aluminum alloy on the inner side of the high-purity aluminum coating is not oxidized. Therefore, an alumite coating 30 having only nanopores 30*a* grows in a perpendicular direction to the cavity face. The surface roughness Ra of the alumite coating 30 is 3 mm or less. Further, the porosity (=total volume of nanopores 30*a*' 100/volume of alumite coating 30) of the alumite coating 30 becomes 20% or less as a result of the formation of the nanopores 30*a*.

Preferably, the anodizing treatment in step S5 is performed under conditions such that the aluminum alloy on the inner side of the high-purity aluminum coating is not oxidized. It is known from empirical knowledge that the coating thickness of an alumite coating is proportional to the current density and the electrolysis time. In step S5, an electrolyte containing 20% sulfuric acid is used, and constant-current electrolysis is performed for 45 minutes at a current density of 51.6 A/cm$^2$ while maintaining the piston temperature (or electrolyte temperature) at 10±5° C. By this means, only the high-purity aluminum coating is oxidized without oxidizing the aluminum alloy on the inner side of the high-purity aluminum coating, and an alumite coating having a coating thickness that is approximately equal to the target coating thickness $T_{TARGET}$ is formed.

In the present embodiment, by making the coating thickness $T_{Al}$ of the high-purity aluminum coating formed in step S4 equal to or greater than one half of the target coating thickness $T_{TARGET}$ and also performing anodizing treatment under the conditions described above in step S5, it is possible to transform only the high-purity aluminum coating into the alumite coating 30 (FIG. 5). If, for example, the coating thickness $T_{Al}$ were made less than one half of the target coating thickness $T_{TARGET}$, the anodizing treatment performed under the conditions described above in step S5 would cause the aluminum alloy on the inner side of the high-purity aluminum coating to be oxidized and micropores 30*b* that are similar to the micropores shown in FIG. 3 would be formed and concavities 30*c* would arise in the surface of the alumite coating 30 (FIG. 6).

Accordingly, it is preferable that, after taking into account the coating thickness $T_{Al}$ of the high-purity aluminum coating formed in step S4, the anodizing treatment in step S5 is performed under conditions (electrolyte composition, piston temperature, current density and electrolysis time) such that the aluminum alloy on the inner side of the high-purity aluminum coating is not exposed.

The description of the method for manufacturing a piston will now be continued referring again to FIG. 1. After performing the anodizing treatment in step S5, the cavity face is masked (step S6). The masking technique is not particularly limited, and for example a masking tape may be attached to the cavity face, or a masking member that is formed to conform to the shape of the piston 10 may be pushed against the cavity face.

After step S6, the squish face is subjected to a sealing treatment (step S7). More specifically, first, a sealing agent is coated onto the squish face. A silicon-based polymer solution that includes silicon in a main chain backbone (more specifically, a polymer solution containing polysilazane or polysiloxane) is used as the sealing agent. The polymer solution may include an additive as necessary. A method for coating the sealing agent is not particularly limited, and a spray method, a blade coating method, a spin coating method and a brush application method may be mentioned as examples thereof. After coating the sealing agent, the sealing agent is dried and baked to form a sealing coating. The conditions (temperature, time period and the like) for drying and baking the sealing agent are appropriately adjusted in accordance with the coating thickness of the sealing agent.

FIG. 7 is a cross-sectional schematic view of the vicinity of the squish portion 26 after the sealing treatment, and corresponds to the cross-sectional schematic view in FIG. 3. As shown in FIG. 7, a sealing coating 32 is formed on the surface of the alumite coating 28. By forming the sealing coating 32, the concavities 28*c* in the surface of the alumite coating 28 can be covered by the sealing coating 32, and the surface roughness Ra of a heat-shielding coating 34 constituted by the alumite coating 28 and the sealing coating 32 can be smoothed to a surface roughness Ra that is less than or equal to 3 mm. Further, by forming the sealing coating 32, the entry of fuel or gas into the micropores 28*b* via the nanopores 28*a* can be suppressed.

FIG. 8 is a cross-sectional schematic view of the vicinity of the cavity portion 20 after the sealing treatment, and corresponds to the cross-sectional schematic view in FIG. 4. As shown in FIG. 8, a sealing coating is not formed on the alumite coating 30. However, because the alumite coating 30 is obtained by subjecting the high-purity aluminum coating to an anodizing treatment, the surface roughness Ra of a heat-shielding coating 36 constituted by the alumite coating 30 is less than or equal to 3 mm, and is adequately smoothed even without forming a sealing coating.

After the sealing coating 32 has been formed, the entire area of the piston top face is polished as necessary after removing the masking from the cavity face. Prior to polishing the piston top face, it is preferable to grind the opening edge 20*a* so that the squish face and the cavity face are continuous with respect to each other. Thus, by performing the above described steps, the piston for a diesel engine of the present embodiment is manufactured.

Note that, in the above described embodiment, step S1 corresponds to a "piston preparation step" in the above described first invention, steps S3 and S4 correspond to an "aluminum coating formation step" in the first invention, step S5 corresponds to an "anodic oxide coating formation step" in the first invention, and steps S6 and S7 correspond to a "sealing coating formation step" in the first invention.

Further, step S2 corresponds to a "grinding step" in the above described third invention.

In this connection, in the above described embodiment, after the entire area of the cavity face is ground in step S2 in FIG. 1, the squish face is masked in step S3, and a high-purity aluminum coating is formed on the cavity face in step S4. However, as shown in FIG. 9, after step S2 and before step S3, the ground face may be subjected to a blasting treatment to increase the adherence between the ground face and the high-purity aluminum coating (step S2').

[Configuration of Piston]

FIG. 10 is a cross-sectional schematic view of a direct injection engine in which a piston manufactured by the flow of operations illustrated in FIG. 1 is mounted. FIG. 10 corresponds to a cross-section A-A in FIG. 2. In FIG. 10, the piston 10 is positioned at compression top dead center. As shown in FIG. 10, the heat-shielding coating 34 is formed on the surface of the squish portion 26, and the heat-shielding coating 36 is formed on the surface of the cavity portion 20.

Naturally, the heat-shielding coatings 34 and 36 both have lower thermal conductivity as well as lower thermal capacity per unit volume than the aluminum alloy. The heat-shielding coatings 34 and 36 also have lower thermal conductivity and lower thermal capacity per unit volume than a conventional ceramic-based heat-shielding coating. According to the heat-shielding coatings 34 and 36, rather than constantly maintaining the surfaces on which the coatings are formed at a high temperature as in the case of the ceramic-based heat-shielding coating, it is possible to cause the temperature of the surfaces on which the coatings are formed to follow the temperature of gas that fluctuates during the cycle of the engine. That is, the temperature of the surfaces on which the coatings are formed can be made a low temperature during a period from an intake stroke to a compression stroke (the upstroke in the case of a two-cycle engine), and made a high temperature during a period from an expansion stroke to an exhaust stroke (the downstroke in the case of a two-cycle engine). Accordingly, by applying the piston on which the heat-shielding coatings 34 and 36 are formed to a direct injection engine, since not only the thermal efficiency of the engine but also the air intake efficiency thereof can be improved, advantageous effects of improving the fuel consumption and reducing the amount of NOx emissions can be obtained.

Further, high pressure injection of fuel from an injector 38 shown in FIG. 10 is performed prior to the compression top dead center. Since an injection hole is provided in the tip of the injector 38, fuel injected at high pressure from the injection hole is injected towards the side wall portion 22 along an axial line of the injection hole as shown in FIG. 10, the fuel collides against the side wall portion 22 in the vicinity of the compression top dead center and self-ignites, and a flame arises as a result. Broken-line arrows shown in FIG. 10 indicate the direction in which a flame that arises grows. That is, the flame flows along the surface of the side wall portion 22 and grows towards the center direction of the ridge portion 24.

As described above referring to FIG. 8, the surface of the heat-shielding coating 36 is smoothed. Accordingly, when the flame is growing as illustrated in FIG. 10, a decrease in the fluidity of the flame due to the heat-shielding coating 36 can be suppressed. Furthermore, the heat-shielding coating 36 is constituted by the alumite coating 30, and does not include a sealing coating. Therefore, the problem that the sealing coating formed on the cavity face is damaged by the penetrating force of fuel that is injected at high pressure from the injector 38 originally does not arise. Thus, the piston manufactured by the flow of operations illustrated in FIG. 1 can cause a heat shielding effect that is produced by the heat-shielding coating 36 to be exerted to the maximum.

REFERENCE SIGNS LIST

10 piston
14 crown portion
14*a* outer edge
20 cavity portion
20*a* opening edge
22 side wall portion
24 ridge portion
26 squish portion
28, 30 alumite coating
28*a*, 30*a* nanopores
28*b*, 30*b* micropores
28*c*, 30*c* concavities
32 sealing coating
34, 36 heat-shielding coating
38 injector

The invention claimed is:

1. A method for manufacturing a piston for a direct injection engine that directly injects fuel into a cavity portion that is formed in a concave shape in a piston top face, the method comprising the steps of:

preparing a piston that has the cavity portion and that is made of an aluminum alloy having an aluminum purity of less than 99.0%;

forming an aluminum coating having an aluminum purity of 99.0% or more over an entire area of a surface of the cavity portion;

after formation of the aluminum coating, forming an anodic oxide coating having pores over an entire area of the piston top face by subjecting the piston top face to an anodizing treatment; and after formation of the anodic oxide coating, forming a sealing coating that seals the pores of the anodic oxide coating on an outer side relative to the cavity portion of the piston top face.

2. The method for manufacturing a piston for a direct injection engine according to claim 1, wherein the aluminum coating which is formed on the surface of the cavity portion has a predetermined thickness, and the anodizing treatment is performed under conditions such that an aluminum alloy that is on an inner side relative to the aluminum coating of the predetermined thickness is not anodized.

3. The method for manufacturing a piston for a direct injection engine according to claim 1, wherein the aluminum coating which is formed on the surface of the cavity portion has a predetermined thickness, the method further comprising the step of, after preparation of the piston made of an aluminum alloy and before formation of the aluminum coating, grinding inwardly a surface of the cavity portion by an amount corresponding to the predetermined thickness.

4. The method for manufacturing a piston for a direct injection engine according to claim 1, wherein the direct injection engine is a diesel engine.

* * * * *